US011458520B2

(12) United States Patent
Heairld

(10) Patent No.: US 11,458,520 B2
(45) Date of Patent: Oct. 4, 2022

(54) BENDER TOOL MEASURING SYSTEM, APPARATUS, AND METHOD

(71) Applicant: Travis Heairld, Farmington, UT (US)

(72) Inventor: Travis Heairld, Farmington, UT (US)

( * ) Notice: Subject to any disclaimer, the term of this patent is extended or adjusted under 35 U.S.C. 154(b) by 104 days.

(21) Appl. No.: 16/740,382

(22) Filed: Jan. 10, 2020

(65) Prior Publication Data

US 2021/0213507 A1 Jul. 15, 2021

(51) Int. Cl.

| | |
|---|---|
| ***B21D 7/14*** | (2006.01) |
| ***B21D 7/08*** | (2006.01) |
| ***B21D 43/00*** | (2006.01) |
| ***B21D 7/024*** | (2006.01) |

(52) U.S. Cl.

CPC ..... *B21D 7/14* (2013.01); *B21D 7/085* (2013.01); *B21D 7/024* (2013.01); *B21D 43/003* (2013.01)

(58) Field of Classification Search

CPC ..... B21D 7/14; B21D 7/085; B21D 7/024; B21D 7/02; B21D 43/003; B21D 11/02; B21D 11/22; B21D 1/08; B21D 7/022; B21D 7/16; B21D 7/063; B21D 7/08; B66F 15/00; B25F 1/00; B23Q 17/2471; B23Q 17/24; G01B 3/56; G01B 9/10; G01B 11/26; G01B 11/00; G01B 11/14; G01B 21/22; G01C 1/00; G01C 1/02; G01C 1/06; G01N 2203/0682

USPC ..... 72/31.04; 7/166, 164, 163, 157

See application file for complete search history.

(56) References Cited

U.S. PATENT DOCUMENTS

| | | | | |
|---|---|---|---|---|
| 2015/0033813 | A1* | 2/2015 | Leclerc | B21D 7/022 72/37 |
| 2017/0095849 | A1* | 4/2017 | Nobles | B21D 7/02 |
| 2020/0282505 | A1* | 9/2020 | Benton | B23Q 17/2471 |

* cited by examiner

*Primary Examiner* — Shelley M Self
*Assistant Examiner* — Teresa A Guthrie
(74) *Attorney, Agent, or Firm* — Intellectual Strategies

(57) ABSTRACT

A bender tool measuring system includes a conduit bender, a bent piece of conduit, and a measurement apparatus coupled to the conduit. The conduit bender includes a bender head comprising a hook and a handle coupled to and extending from the bender head. The measurement apparatus is configured to project an optical projection onto the handle of the conduit bender, and the location of the optical projection on the length of the handle indicates the position of the bent piece of conduit in relation to the bender head.

20 Claims, 12 Drawing Sheets

BENDER TOOL MEASURING SYSTEM, APPARATUS, AND METHOD

FIELD

This disclosure relates generally to measuring systems, apparatuses, and methods for bender tools. More specifically, this disclosure relates to a bender tool optical measuring system.

SUMMARY

The subject matter of the present application has been developed in response to the present state of the art, and in particular, in response to the problems and disadvantages associated with conventional bender tools that have not yet been fully solved by currently available techniques. Accordingly, the subject matter of the present application has been developed to provide embodiments of measuring systems, apparatuses, and methods for bender tools that overcome at least some of the shortcomings of prior art techniques.

Disclosed herein is a bender tool measuring system. The system includes a conduit bender, a bent piece of conduit, and a measurement apparatus coupled to the conduit. The conduit bender includes a bender head comprising a hook and a handle coupled to and extending from the bender head. The measurement apparatus is configured to project an optical projection onto the handle of the conduit bender, and the location of the optical projection on the length of the handle indicates the position of the bent piece of conduit in relation to the bender head. The preceding subject matter of this paragraph characterizes example 1 of the present disclosure.

The measurement apparatus includes an optical device and an attachment device. The preceding subject matter of this paragraph characterizes example 2 of the present disclosure, wherein example 2 also includes the subject matter according to example 1, above.

The measurement apparatus further includes a power source and a switch configured to provide power to the optical device. The preceding subject matter of this paragraph characterizes example 3 of the present disclosure, wherein example 3 also includes the subject matter according to any one of examples 1-2, above.

The optical device includes a laser. The preceding subject matter of this paragraph characterizes example 4 of the present disclosure, wherein example 4 also includes the subject matter according to any one of examples 1-3, above.

The measurement apparatus is coupled to the conduit by a magnet. The preceding subject matter of this paragraph characterizes example 5 of the present disclosure, wherein example 5 also includes the subject matter according to any one of examples 1-4, above.

The measurement apparatus is coupled to a first linear section of the conduit on an underside of the first linear section next to a first bent section of the conduit. The preceding subject matter of this paragraph characterizes example 6 of the present disclosure, wherein example 6 also includes the subject matter according to any one of examples 1-5, above.

The measurement apparatus is coupled to the conduit by a strap. The preceding subject matter of this paragraph characterizes example 7 of the present disclosure, wherein example 7 also includes the subject matter according to any one of examples 1-6, above.

The measurement apparatus includes a housing with a laser, a power source, and a switch configured to provide power to the optical device within the housing and an attachment device configured to couple the housing to the conduit. The preceding subject matter of this paragraph characterizes example 8 of the present disclosure, wherein example 8 also includes the subject matter according to any one of examples 1-7, above.

The measurement apparatus is configured to project the laser at an angle from the first linear section of the conduit. The preceding subject matter of this paragraph characterizes example 9 of the present disclosure, wherein example 9 also includes the subject matter according to any one of examples 1-8, above.

The handle includes markings. The preceding subject matter of this paragraph characterizes example 10 of the present disclosure, wherein example 10 also includes the subject matter according to any one of examples 1-9, above.

The markings vary in distance between each other. The preceding subject matter of this paragraph characterizes example 11 of the present disclosure, wherein example 11 also includes the subject matter according to any one of examples 1-10, above.

The location of the optical projection on the length of the handle indicates the position of the bent piece of conduit in relation to the bender head. The preceding subject matter of this paragraph characterizes example 12 of the present disclosure, wherein example 12 also includes the subject matter according to any one of examples 1-11, above.

The location of the optical projection on the length of the handle indicates an offset distance between a first linear section of the bent piece of conduit and an offset linear section of the bent piece of conduit, wherein the offset linear section is parallel to the first linear section. The preceding subject matter of this paragraph characterizes example 13 of the present disclosure, wherein example 13 also includes the subject matter according to any one of examples 1-12, above.

Disclosed herein is a measurement apparatus for a bender tool. The apparatus includes a housing and an attachment device. The housing includes an optical device and a power source configured to power the optical device. The attachment device is configured to couple the housing to a bent piece of conduit, wherein the optical device is configured to project an optical projection onto a handle of a conduit bender. The preceding subject matter of this paragraph characterizes example 14 of the present disclosure.

The location of the optical projection on the length of the handle indicates the position of the bent piece of conduit in relation to the bender head. The preceding subject matter of this paragraph characterizes example 15 of the present disclosure, wherein example 15 also includes the subject matter according to example 14, above.

The location of the optical projection on the length of the handle indicates an offset distance between a first linear section of the bent piece of conduit and an offset linear section of the bent piece of conduit, wherein the offset linear section is parallel to the first linear section. The preceding subject matter of this paragraph characterizes example 16 of the present disclosure, wherein example 16 also includes the subject matter according to any one of examples 14-15, above.

The measurement apparatus is coupled to the conduit by a magnet. The preceding subject matter of this paragraph characterizes example 17 of the present disclosure, wherein example 17 also includes the subject matter according to any one of examples 14-16, above.

The optical device comprises a laser, wherein the measurement apparatus is configured to project the laser at an angle from the first linear section of the conduit. The preceding subject matter of this paragraph characterizes example 18 of the present disclosure, wherein example 18 also includes the subject matter according to any one of examples 14-17, above.

Disclosed herein is a method. The method includes coupling a measurement apparatus to a piece of bent conduit, wherein measurement apparatus comprises an optical device. The method further includes projecting an optical projection from the optical device onto a handle of a conduit bender. The method further includes sliding the piece of bent conduit along the conduit bender. The method further includes bending the piece of bent conduit in a second location. The preceding subject matter of this paragraph characterizes example 19 of the present disclosure.

The location of the optical projection on the length of the handle indicates an offset distance between a first linear section of the bent piece of conduit and an offset linear section of the bent piece of conduit, wherein the offset linear section is parallel to the first linear section. The preceding subject matter of this paragraph characterizes example 20 of the present disclosure, wherein example 20 also includes the subject matter according to any one of examples 19, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
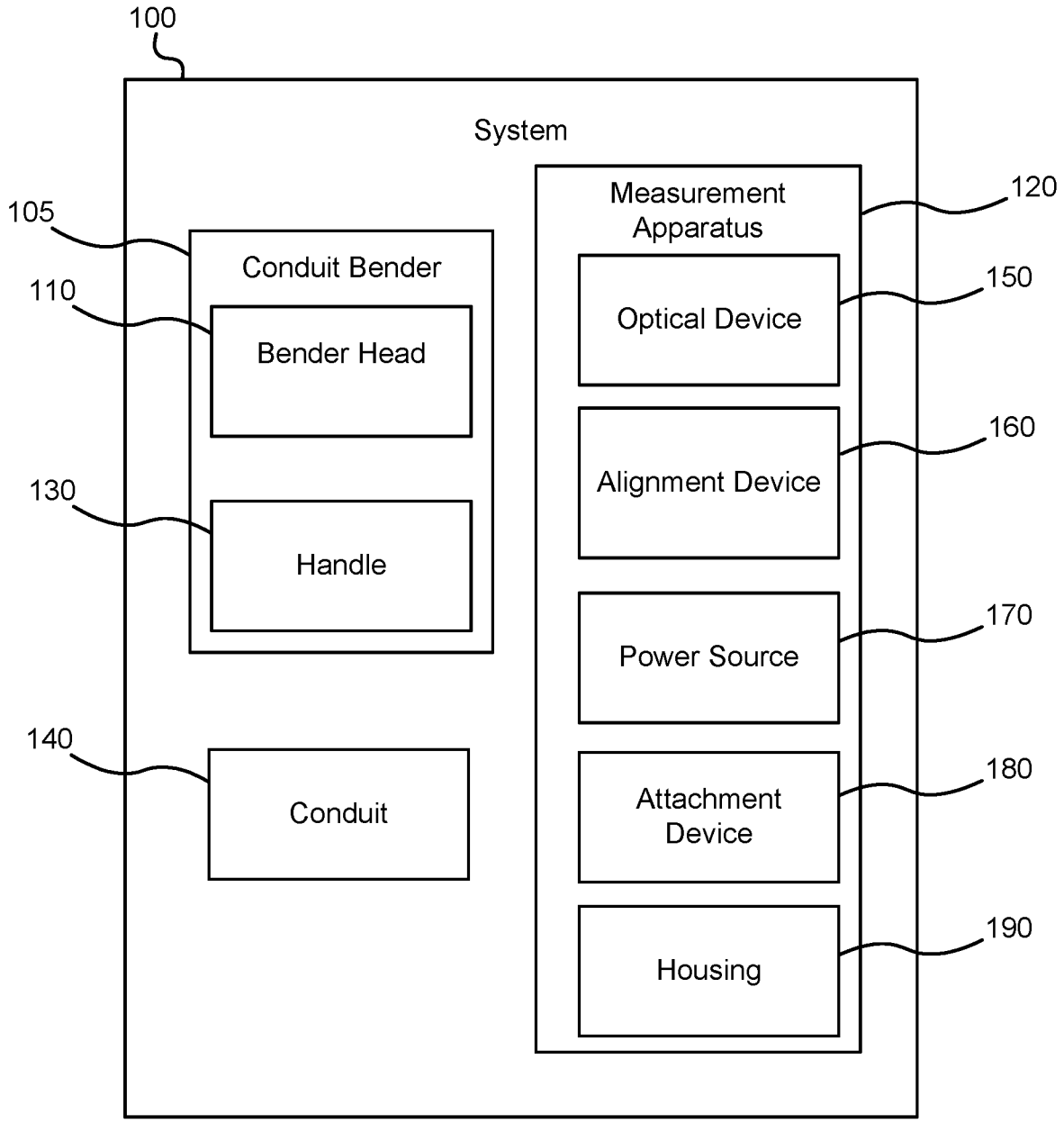
FIG. 1 is a schematic diagram of a bender measuring system, according to one or more embodiments of the present disclosure.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

Other aspects, as well as features and advantages of various aspects, of the disclosed subject matter will be apparent to those of ordinary skill in the art through consideration of this disclosure and the appended claims.

Bending of conduit and other piping can be difficult. Measurements are needed and sometimes those measurements are difficult. They may require repeated measurements to make sure that no mistakes are made, and bends are performed at the correct location and at the correct angle. The difficulty is compounded by the need for multiple bends and needing the bends to be offset from each other correctly. As this is a repetitive time-consuming task, many ideas have been developed to speed up this process or help reduce the manual labor required to make the measurements. However, the conventional solutions still require too much time or are prohibitively expensive to be implemented.

Embodiments described herein reduce the time needed to make measurements and can be done without expensive equipment. Some embodiments allow for the easy transfer of components such that the components can be used on various different bender tools (whether those differences are found in different manufacturers or different sizes). Embodiments described herein reduce capital costs and labor costs by allowing for quicker and more accurate measurements and faster bending of conduit and other pipes.

Embodiments described herein may be used to more efficiently measure and bend conduit, saving time and effort on each bend. Some embodiments include a bender tool measuring system. In some embodiments, the system includes a conduit bender, a bent piece of conduit, and a measurement apparatus coupled to the conduit. In some embodiments, the conduit bender includes a bender head comprising a hook and a handle coupled to and extending from the bender head. In some embodiments, the measurement apparatus is configured to project an optical projection onto the handle of the conduit bender, and the location of the optical projection on the length of the handle indicates the position of the bent piece of conduit in relation to the bender head.

In some embodiments, the measurement apparatus includes an optical device and an attachment device. In some embodiments, the measurement apparatus further includes a power source and a switch configured to provide power to the optical device. In some embodiments, the optical device includes a laser.

In some embodiments, the measurement apparatus is coupled to the conduit by a magnet. In some embodiments, the measurement apparatus is coupled to a first linear section of the conduit on an underside of the first linear section next to a first bent section of the conduit.

In some embodiments, the measurement apparatus is coupled to the conduit by a strap. In some embodiments, the measurement apparatus includes a housing with a laser, a power source, and a switch configured to provide power to the optical device within the housing and an attachment device configured to couple the housing to the conduit. In some embodiments, the measurement apparatus is configured to project the laser at an angle from the first linear section of the conduit.

In some embodiments, the handle includes markings. In some embodiments, the markings vary in distance between each other. In some embodiments, the location of the optical projection on the length of the handle indicates the position of the bent piece of conduit in relation to the bender head. In some embodiments, the location of the optical projection on the length of the handle indicates an offset distance between a first linear section of the bent piece of conduit and an offset linear section of the bent piece of conduit, wherein the offset linear section is parallel to the first linear section.

Some embodiments described herein include a measurement apparatus for a bender tool. In some embodiments, the apparatus includes a housing and an attachment device. In some embodiments, the housing includes an optical device and a power source configured to power the optical device. In some embodiments, the attachment device is configured to couple the housing to a bent piece of conduit, wherein the optical device is configured to project an optical projection onto a handle of a conduit bender.

In some embodiments, the location of the optical projection on the length of the handle indicates the position of the bent piece of conduit in relation to the bender head. In some embodiments, the location of the optical projection on the length of the handle indicates an offset distance between a first linear section of the bent piece of conduit and an offset linear section of the bent piece of conduit, wherein the offset linear section is parallel to the first linear section.

In some embodiments, the measurement apparatus is coupled to the conduit by a magnet. In some embodiments, the optical device comprises a laser, wherein the measurement apparatus is configured to project the laser at an angle from the first linear section of the conduit.

Some embodiments disclosed herein include a method. In some embodiments, the method includes coupling a measurement apparatus to a piece of bent conduit, wherein measurement apparatus comprises an optical device. In some embodiments, the method further includes projecting an optical projection from the optical device onto a handle of a conduit bender. In some embodiments, the method further includes sliding the piece of bent conduit along the conduit bender. In some embodiments, the method further includes bending the piece of bent conduit in a second location.

In some embodiments, the location of the optical projection on the length of the handle indicates an offset distance between a first linear section of the bent piece of conduit and an offset linear section of the bent piece of conduit, wherein the offset linear section is parallel to the first linear section.

Referring to FIG. 1, a schematic diagram of a bender tool measuring system 100 is shown. The system 100 includes a conduit bender 105, a measurement apparatus 120, and conduit 140. Although the system 100 is shown and described with certain components and functionality in the following paragraphs, other embodiments of the system 100 may include fewer or more components to implement less or more functionality.

In some embodiments, the system 100 includes a conduit bender 105, a measurement apparatus 120, and conduit 140. In some embodiments, the system 100 includes only the measurement apparatus 120. In some embodiments, the system 100 incudes the measurement apparatus 120 and the conduit bender 105. Various configurations are contemplated herein.

The conduit bender 105, in some embodiments, includes multiple parts. In some embodiments, the conduit bender 105 includes a bender head 110 and a handle 130. In some embodiments, the bender head 110 and the handle 130 are one continuous piece. In some embodiments, the bender head 110 and the handle 130 are separate pieces that are coupled together. The handle 130 may be inserted into an opening on the bender head 110 and extend orthogonal from the bender head 110. The bender head 110 is configured to bend a piece of conduit 140 while a user utilizes the handle 130 for leverage. The positioning of the conduit 140 within the bender head 110 determines the location of the bend in the conduit 140. Various types of bender heads 110 and handles 130 are contemplated herein.

Figure 13:
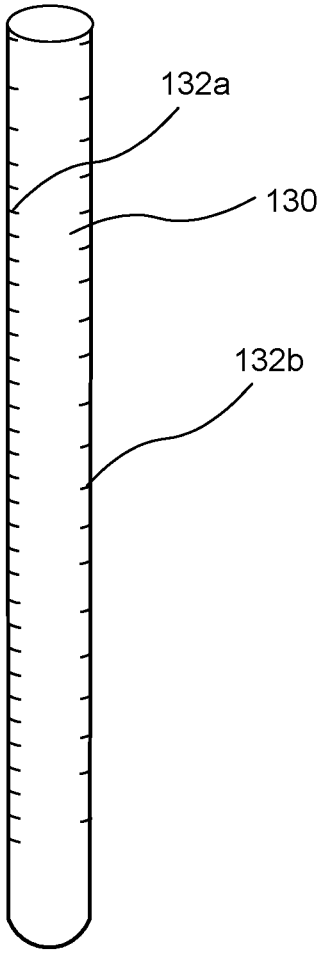
FIG. 13 is a front view of a handle of a bender apparatus, according to one or more embodiments of the present disclosure.

In some embodiments, the handle 130 includes markings that are inscribed on the length of the handle 130. The markings may be inscribed on the handle 130 or otherwise externally indicated on the handle 130 by use of a sticker or a sleeve or another type of structure that can be adhered to or positioned on the handle 130. In some embodiments, the markings extend completely around the circumference of the handle 130. In some embodiments, the markings are only indicated on one side of the handle 130. In some embodiments, the handle 130 may include more than one set of markings. That is, the markings on side of the handle 130 may differ in their distance between each other, allowing for different types of measurements to occur (see for example FIG. 13 with first set of markings 132*a* and second set of markings 132*b*).

In some embodiments, the system 100 includes conduit 140. The conduit 140 can be made of any material and any size that can be bent by a conduit bender 105.

The system 100 includes a measurement apparatus 120. Although the measurement apparatus 120 is shown and described with certain components and functionality in the following paragraphs, other embodiments of the measurement apparatus 120 may include fewer or more components to implement less or more functionality.

In the illustrated embodiment, the measurement apparatus 120 includes an optical device 150, an alignment device 160, a power source 170, an attachment device 180, and a housing 190.

In some embodiments, the measurement apparatus 120 is configured to project an optical signal. The optical signal may be generated by an optical device 150 that is in the measurement apparatus 120. The optical signal is projected onto the handle 130 at or near the markings on the handle 130. The location of the optical signal along the markings may indicate a measurement that can be used to more accurately and quickly measure where a bend in the conduit is to take place.

Figure 11:
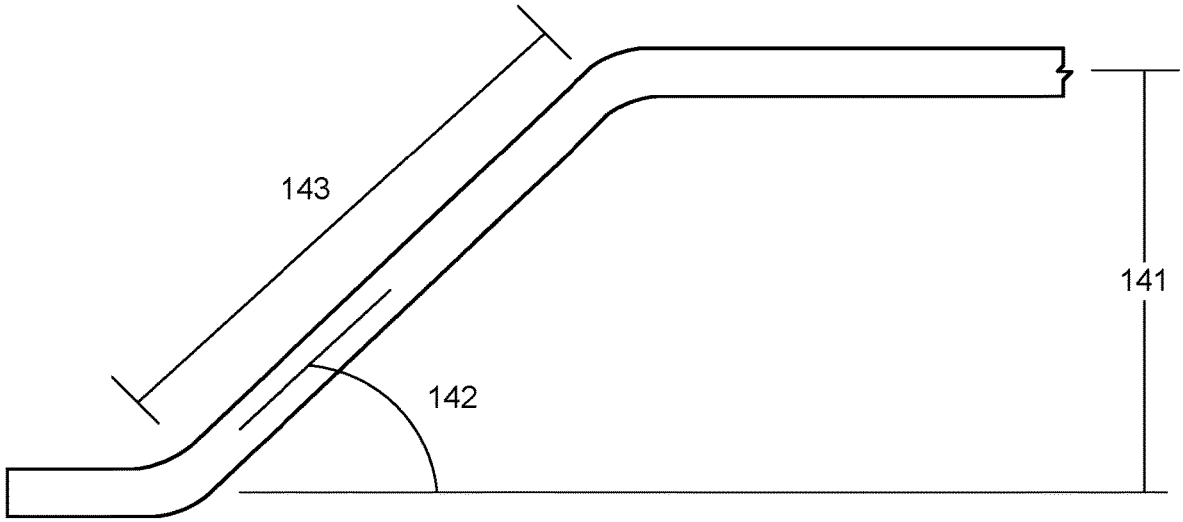
FIG. 11 is a partial front view of a bent conduit, according to one or more embodiments of the present disclosure.
Figure 12:
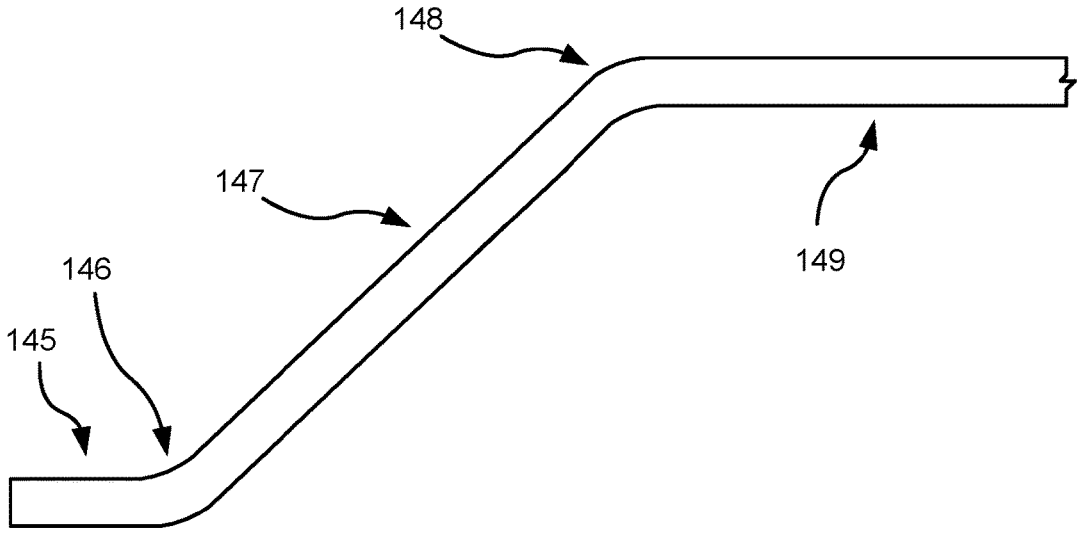
FIG. 12 is a partial front view of a bent conduit, according to one or more embodiments of the present disclosure.

Referring to FIGS. 11 and 12, a bent piece of conduit 140 is shown. The conduit includes two bends, a first bend 146 and a second bend 148. The two bends in the conduit allow for the conduit to be offset by an offset distance 141. As conduit is run, offsets may need to happen to allow the conduit to move levels within a building. Measurements are taken to determine what bend angle 142 and what angle length 143 is needed to result a particular offset distance 141 in the conduit. Typically, the user of a bender tool would make a first bend 146 in the conduit. After making the first bend 146 at a particular bend angle 142, the user will make a measurement 143 to determine where the second bend 148 is to take place. This is determined by geometry with the goal, typically, of reaching a particular offset distance 141. These measurements may be tedious and difficult to make as a tape measurer may be needed and a marking device to mark where the second bend 148 is to take place. After the two bends are made, the conduit includes a first linear section 145, an angled section 147, and an offset linear section 149 offset from the first linear section 145. The first linear section 145 is the part of the conduit before the first bend 146. The angled section 147 is the part of the conduit between the first bend 146 and the second bend 148. The offset linear section 149 is the part of the conduit after the second bend 148. Although the foregoing indicates a first and second bend, it is contemplated that there may be more than two bends on a piece of conduit. As such, the reference to a first bend 146 and a second bend 148 refers to any two consecutive bends along the conduit regardless of where those bends may occur along the conduit.

Referring again to FIG. 1, the measurement apparatus 120 is configured to project an optical projection onto the handle 130 of the conduit bender 105. The optical projection eliminates the need to measure a length between the first bend 146 and where the second bend 148 will need to occur. As discussed elsewhere, as the conduit 140 is slid along the bender head 110, the measurement apparatus 120 will change the location of the optical projection along the handle 130. Once the optical projection is projecting at the correct marking, the user can bend the conduit to make the second bend 148 without measuring the conduit 140 itself.

In some embodiments, the measurement apparatus 120 includes an optical device 150. The optical device 150 is configured, in some embodiments, to project the optical projection. The optical projection may be any linear optical projection that can indicate a position on the handle 130 of the conduit bender 105. In some embodiments, the optical device 150 may be a LASER. The optical device 150 may be any device that is capable of projecting a coherent optical signal on the handle 130.

In some embodiments, the measurement apparatus 120 includes an alignment device 160. The alignment device 160 is configured to align the measurement apparatus 120 on the conduit 140 such that the optical projection will hit the handle 130 of the conduit bender 105.

In some embodiments, the measurement apparatus 120 includes a power source 170. The power source 170 may be configured to power the optical device 150. The power source 170 may be portable and capable of powering the optical device 150 through wired or wireless technologies. The power source 170, in some embodiments, is a battery. In some embodiments, the power source 170 is internal to the measurement apparatus 120. In some embodiments, the power source 170 is external to the measurement apparatus 120. In some embodiments, the power source 170 may be turned on or off. In some embodiments, the power source 170 continually powers the optical device 150 which continually projects the optical projection from the measurement apparatus 120.

In some embodiments, the measurement apparatus 120 includes an attachment device 180. The attachment device 180 is configured to couple the measurement apparatus 120 to the conduit 140. The attachment device 180 may be any type of attachment apparatus that secures the measurement apparatus 120 to the conduit 140 without allowing the measurement apparatus 120 to translate, rotate, or otherwise move relative to the conduit 140. In some embodiments, the attachment device 180 includes magnets that magnetically couple the measurement apparatus 120 to the conduit 140. In other embodiments, the attachment device 180 may be straps that are wrapped around the conduit 140. In other embodiments, adhesive materials may be used. Embodiments described herein include any type of attachment apparatus that can releasably couple the measurement apparatus 120 to the conduit 140.

In some embodiments, the measurement apparatus 120 includes a housing 190. The housing 190 may be configured to house the other components of the measurement apparatus including, but not limited to, the optical device 150, the alignment device 160, the power source 170, and the attachment device 180.

Figure 2:
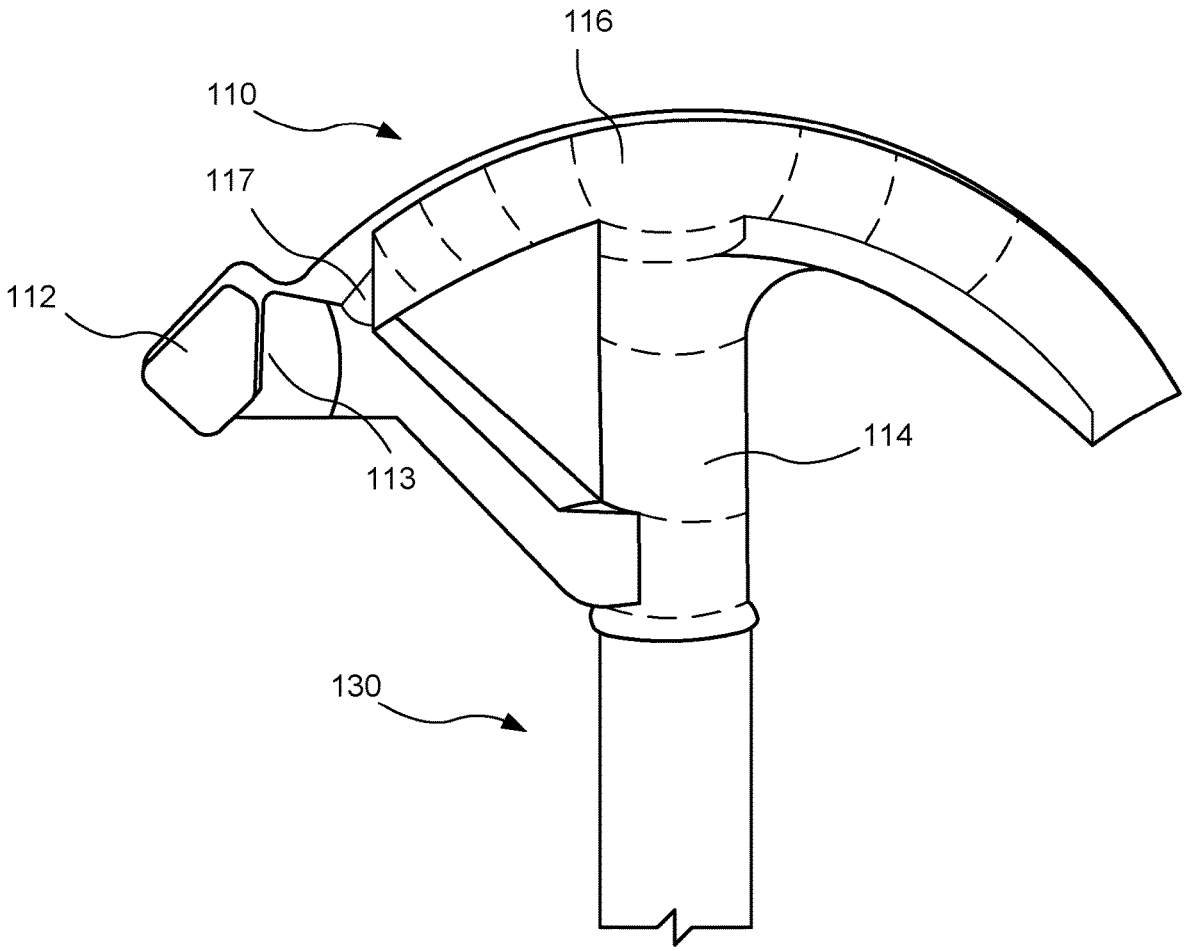
FIG. 2 is a close-up front view of a bender apparatus, according to one or more embodiments of the present disclosure.
Figure 3:
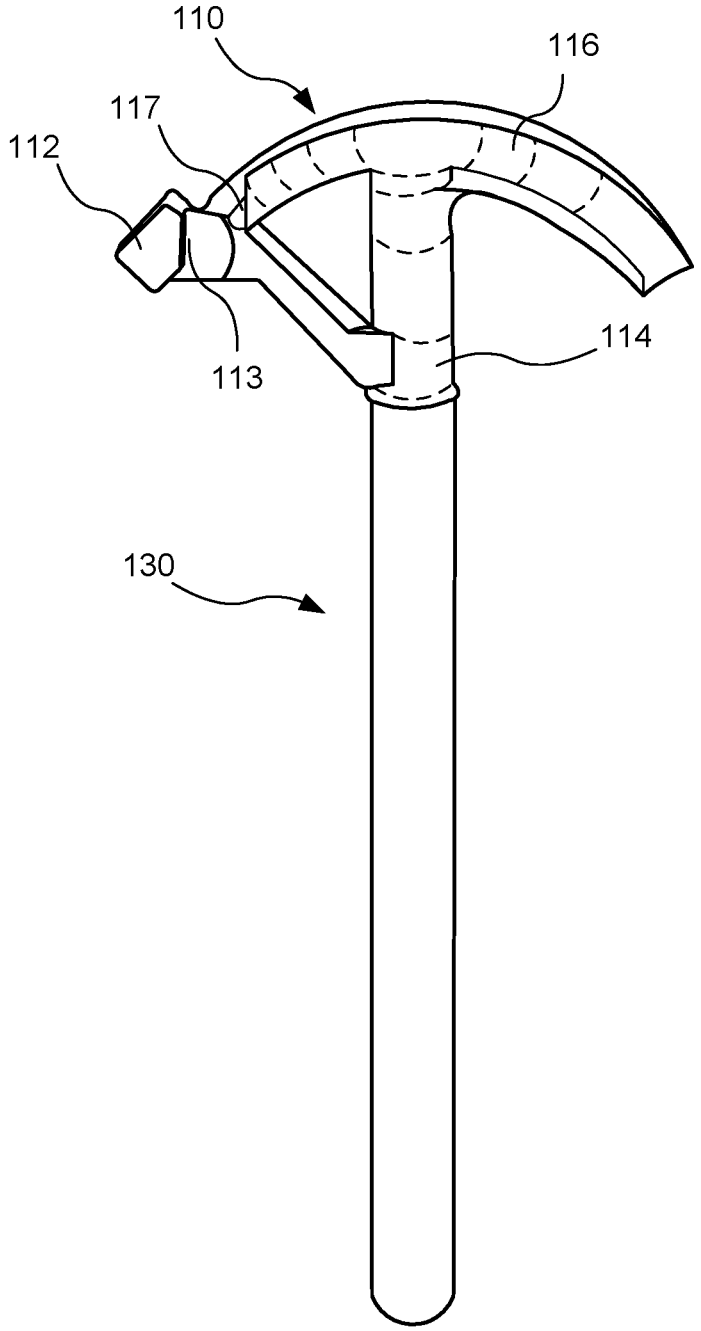
FIG. 3 is a front view of a bender apparatus, according to one or more embodiments of the present disclosure.

Referring now to FIG. 2, a close-up front view of a bender apparatus or bender tool is shown. Although the bender tool is shown and described with certain components and functionality in the following paragraphs, other embodiments of the bender tool may include fewer or more components to implement less or more functionality. The bender tool includes a bender head 110 and a handle 130. The handle 130 couples to the bender head 110 within a sleeve 114 and extends out from the bender head 110. The bender head 110 includes various features and components that are configured to help bend conduit. The bender head 110 includes a hook 112. The hook 112 is configured hold the conduit in place as the conduit is bent along a cradle 116. The conduit sits in hook space 113 and cradle space 117 and is bent along the cradle 116. Referring to FIG. 3, a view of the entirety of the handle 130 is shown with the bender head 110.

Figure 4:
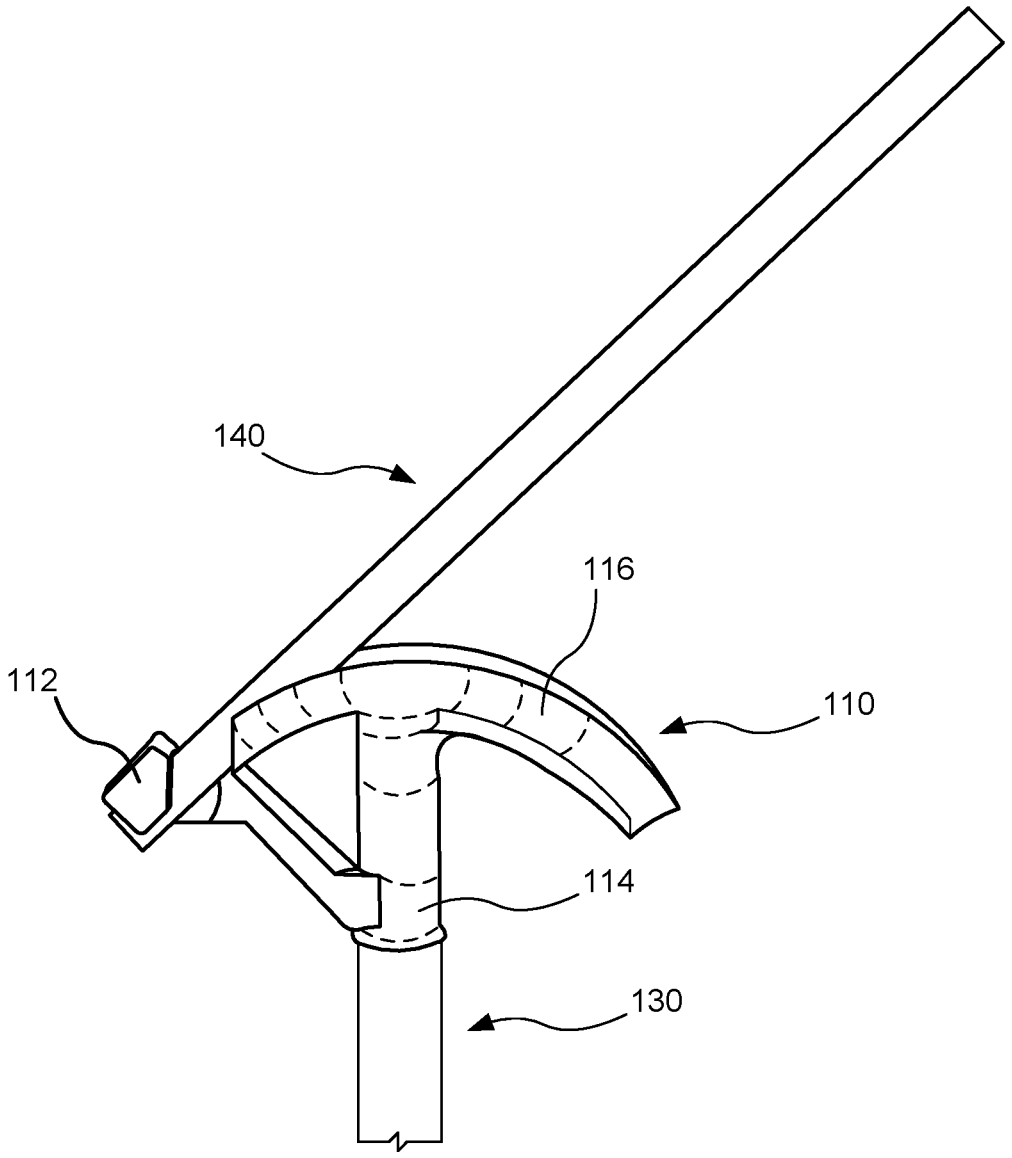
FIG. 4 is a partial front view of a bender apparatus and conduit, according to one or more embodiments of the present disclosure.
Figure 5:
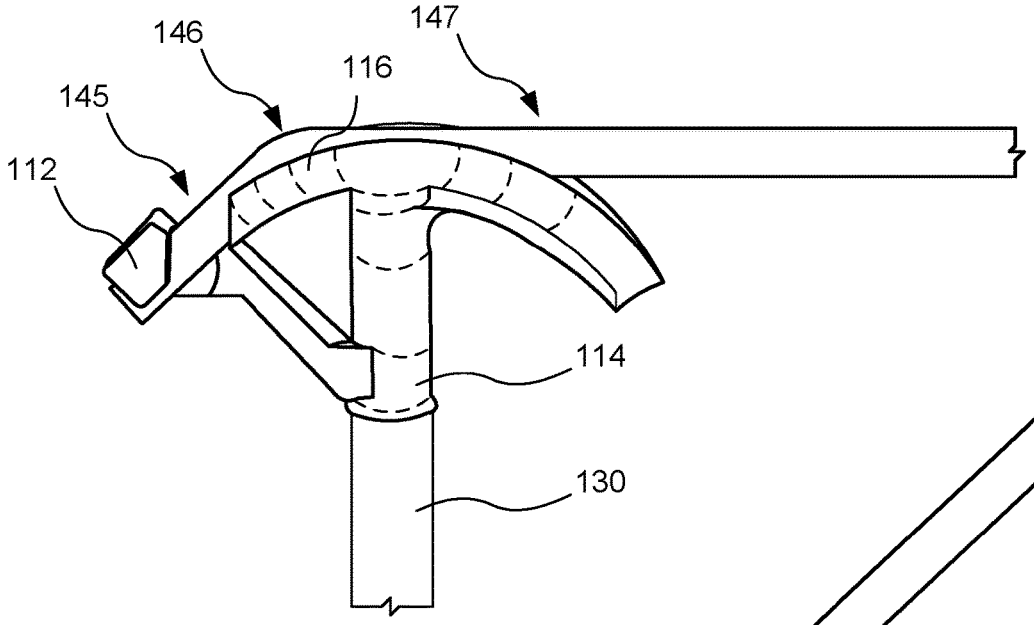
FIG. 5 is a partial front view of a bender apparatus and a conduit with a first bend, according to one or more embodiments of the present disclosure.
Figure 6:
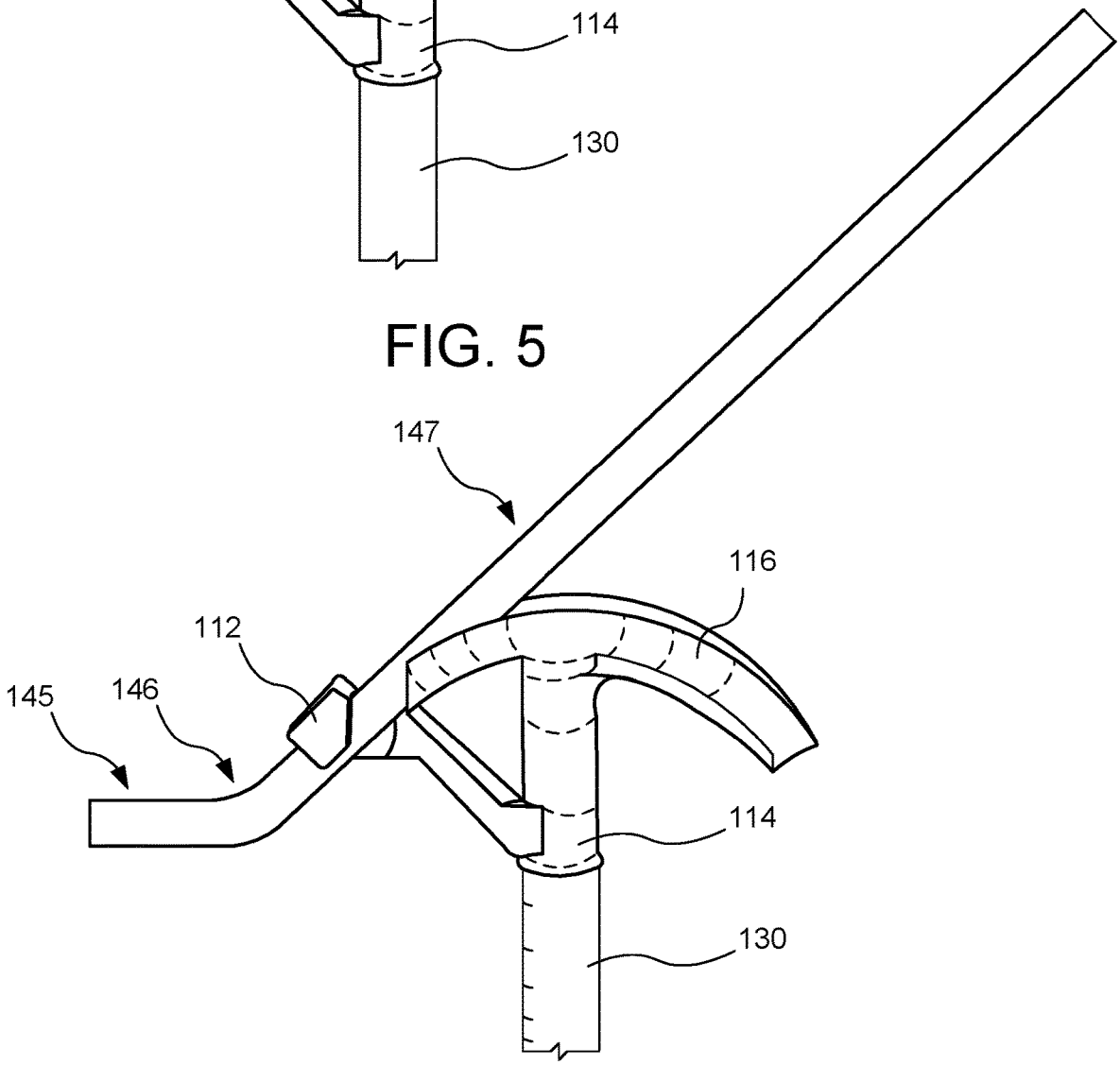
FIG. 6 is a partial front view of a bender apparatus and a conduit with a first bend that has been repositioned, according to one or more embodiments of the present disclosure.
Figure 7:
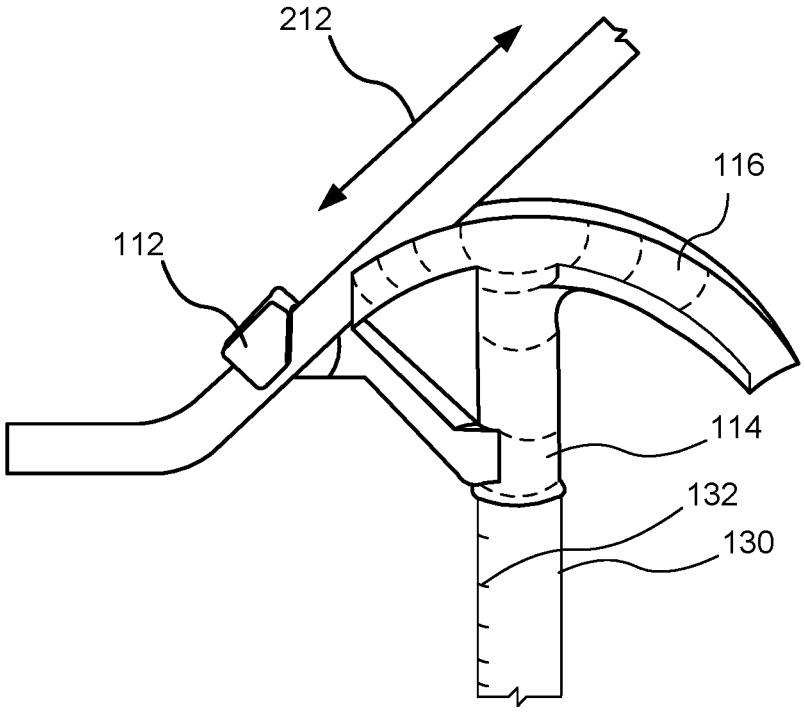
FIG. 7 is a partial front view of a bender apparatus and a conduit with a first bend that has been repositioned, according to one or more embodiments of the present disclosure.
Figure 8:
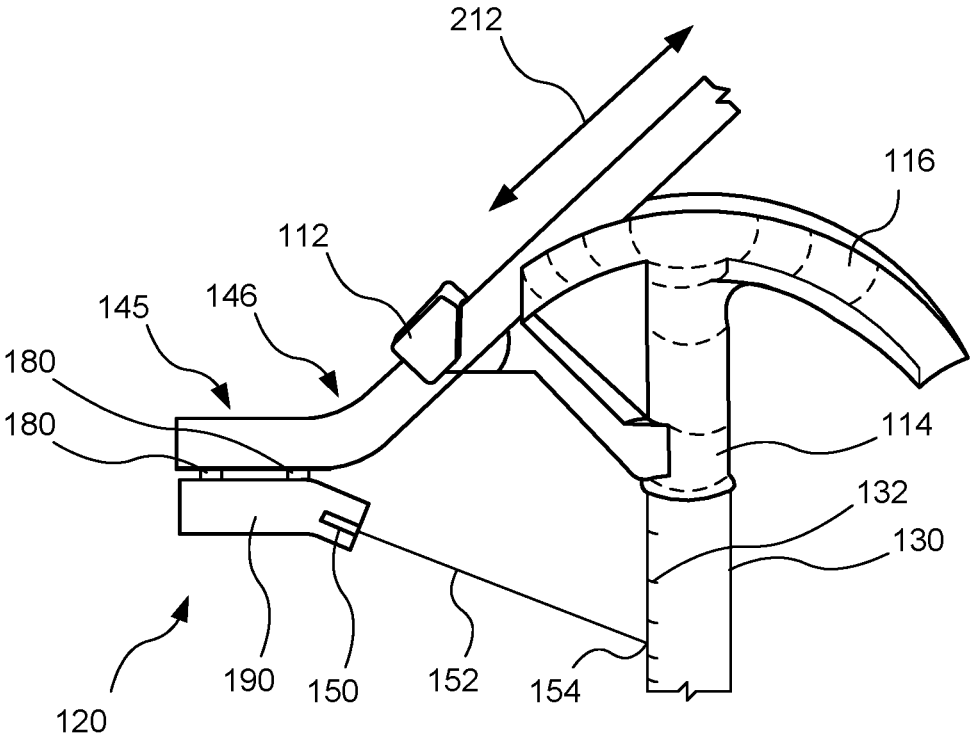
FIG. 8 is a partial front view of a bender apparatus and a conduit with a first bend that has been repositioned with a measurement apparatus coupled to the conduit, according to one or more embodiments of the present disclosure.

Referring to FIG. 4, a piece of conduit 140 is shown in bender tool prior to bending. As shown, the conduit 140 is secured by the hook 112 and can be bent down over the cradle 116. Referring to FIG. 6, the conduit 140 is shown after it is bent. The conduit includes different sections or portions now including a first linear section 145, a first bend 146 and an angled section 147. Referring now to FIG. 5, after the first bend 146 is made, the conduit is repositioned to take out the first linear section 145 from the hook 112 and position the angled section 147 in the hook 112. This allows a second bend to made on the conduit 140 along the angled section 147. Referring to FIGS. 7 and 8, the conduit 140 can be moved along the bender head (shown by directional arrows 212).

Referring now to FIG. 8, a measurement apparatus 120 has been attached to the conduit 140 at the first linear section 145. The measurement apparatus 120 may be attached at a location near or adjacent the first bend 146. Although not shown, the measurement apparatus 120 may include an alignment device 160 that aligns the measurement apparatus 120 on the conduit 140. In some embodiments, the alignment device 160 (not shown) may position the measurement apparatus 120 at a predetermined distance from the first bend 146.

Figure 9:
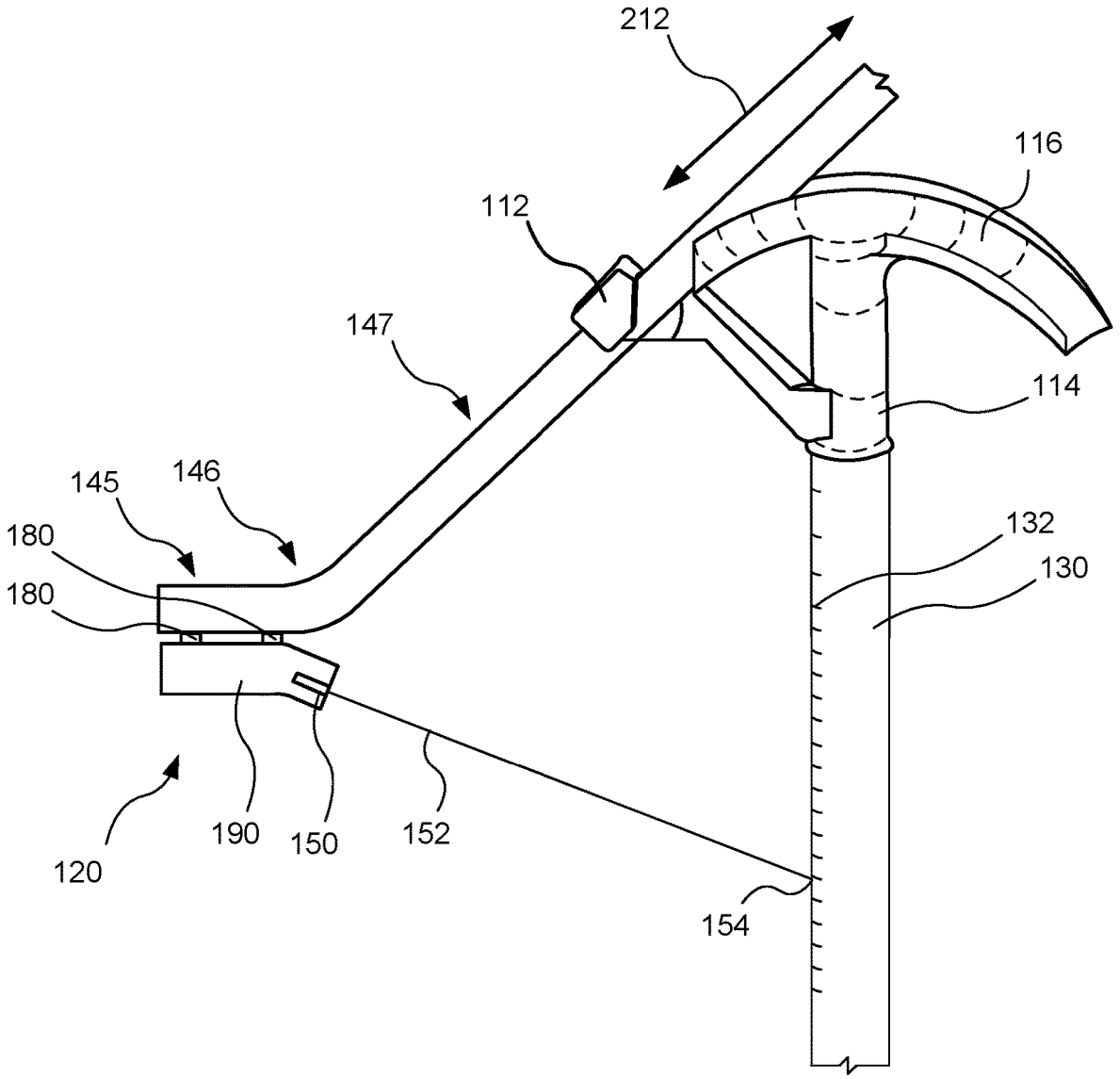
FIG. 9 is a partial front view of a bender apparatus and a conduit with a first bend that has been repositioned with a measurement apparatus coupled to the conduit, according to one or more embodiments of the present disclosure.

The measurement apparatus 120 includes an optical device 150 within a housing 190. The optical device 150 is projecting a laser at a location 154 on the handle 130. As shown, the handle 130 has a plurality of markings 132. Referring now to FIG. 9, the conduit 140 has been translated relative to the bender head 110 along the angled section 147. As the conduit moves, the optical projection moves along the handle 130. Depending on the location 154 of the optical projection will indicate where the second bend will occur. The markings 132 may indicate various things to the user. For example, the markings 132 may indicate an offset distance 141. That is, instead of calculating a distance between two bends along the conduit, the markings 132 will indicate the offset distance that will be achieved of the second bend is applied while the optical projection is at a particular location 154. In another example, the markings 132 can indicate a length measurement 143. As can be contemplated, the markings 132 for each type of measurement would be different.

Figure 10:
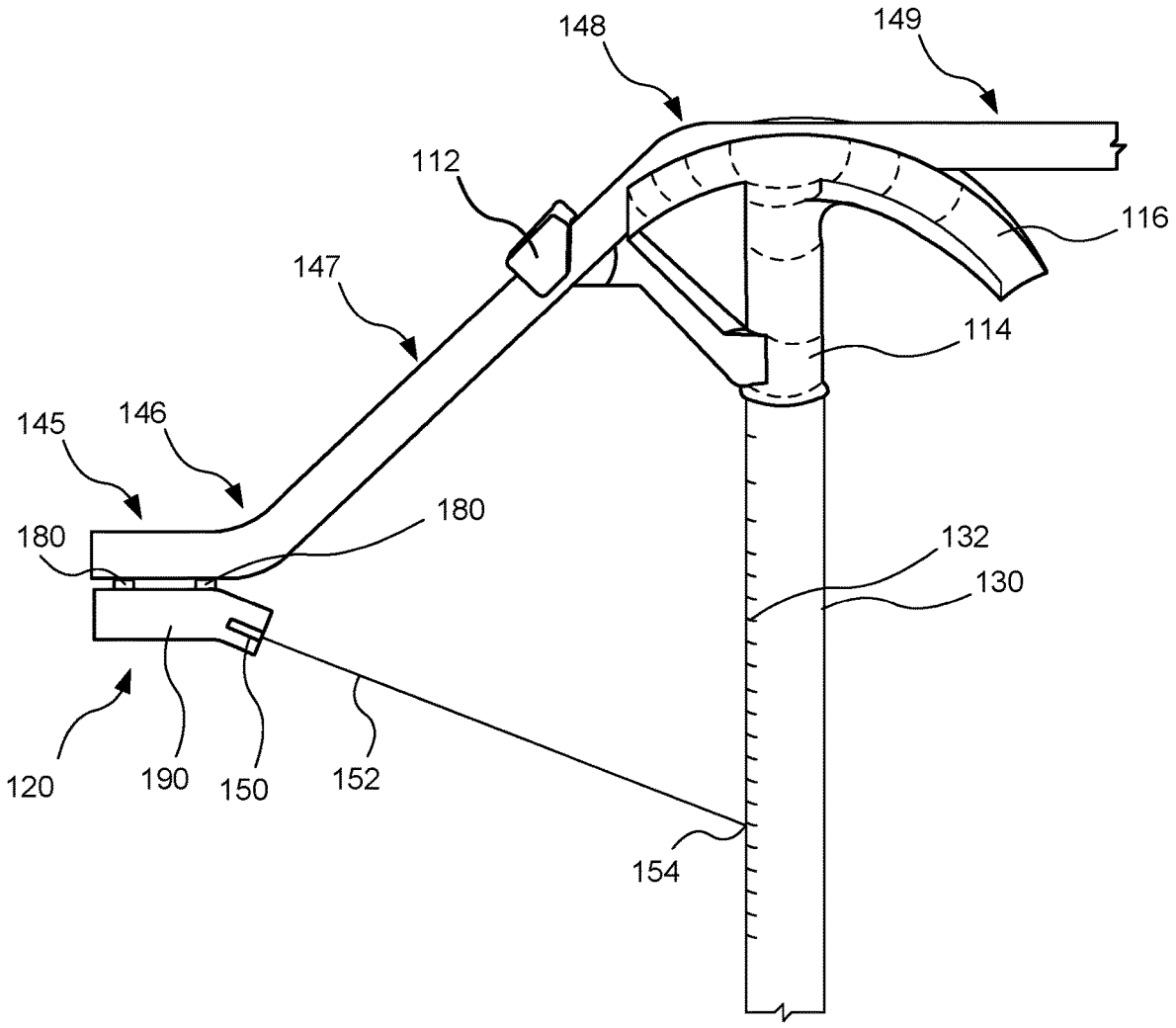
FIG. 10 is a partial front view of a bender apparatus and a conduit with a first bend and a second bend with a measurement apparatus coupled to the conduit, according to one or more embodiments of the present disclosure.

Referring to FIG. 10, the conduit is shown with a second bend 148. The location of the second bend 148 would not need to be measured along the conduit because the location 154 of the optical projection would indicate the offset distance needed. As shown the measurement apparatus 120 includes an angled elbow in the housing 190. The angled elbow allows for the optical projection to proceed at an angle relative to the first linear section 145. That is, the coupling of the measurement apparatus to the conduit allows for the predictable locating of the laser along handle 130. The geometry necessary will adjust the markings 132 on the handle 130 depending on the angle of the optical projection and the location of the optical device 150 relative to the conduit. That is, a thinner or thicker measurement apparatus 120 would place the optical device 150 at a lesser or greater distance from the first linear section 145. That distance could affect the location of the markings 132 on the handle 130. However, as long as the measurement apparatus 120 size is known and position and angle of the optical projection are known relative to the first linear section 145, the position of where the second bend 148 is located correlates with the markings 132.

Figure 14:
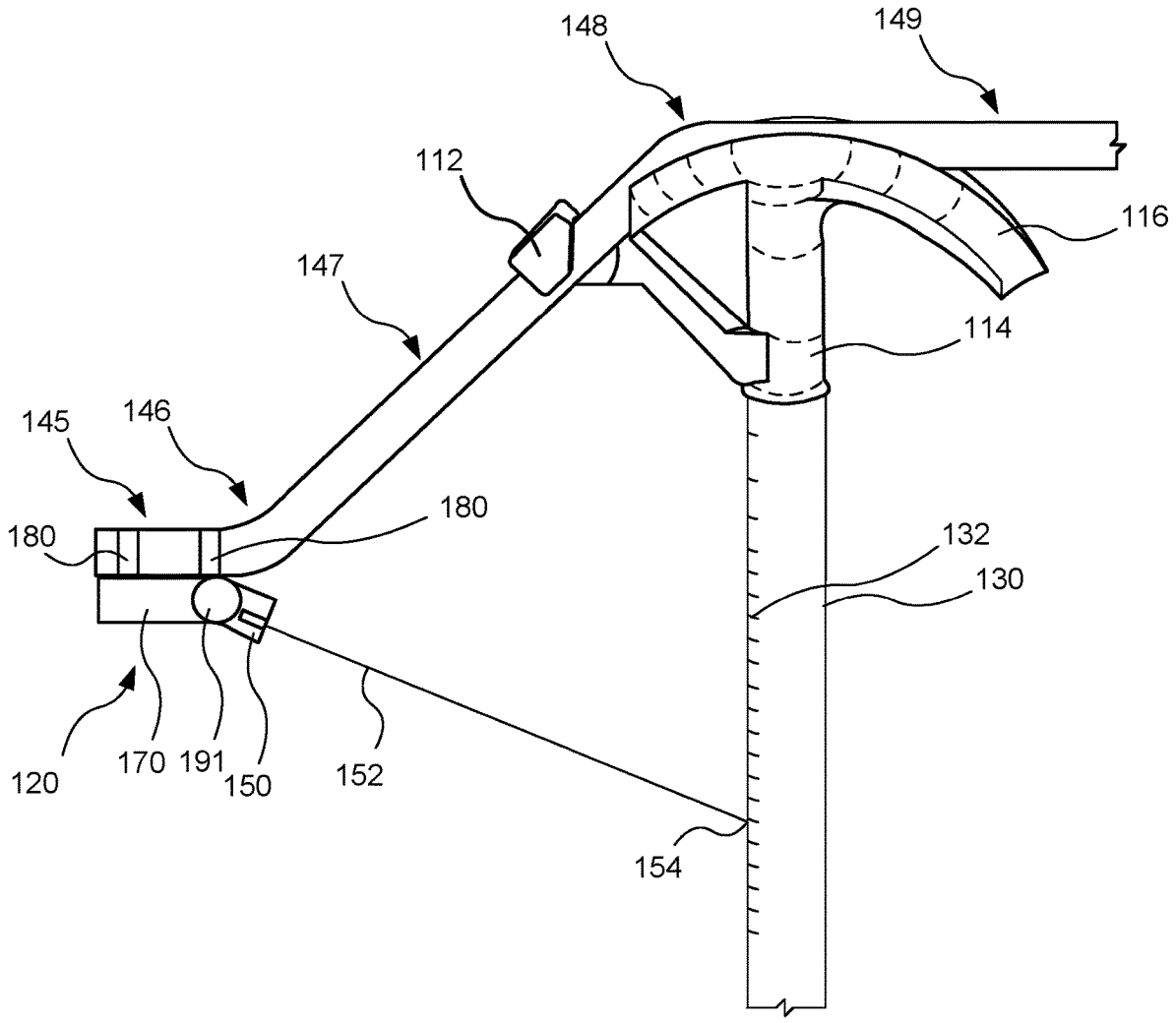
FIG. 14 is a partial front view of a bender apparatus and a conduit with a first bend and a second bend with a measurement apparatus coupled to the conduit, according to one or more embodiments of the present disclosure.

Referring to FIG. 14, a partial front view of a bender apparatus and a conduit with a first bend and a second bend with a measurement apparatus coupled to the conduit is shown. The measurement apparatus 120 may include some or all the features discussed in conjunction with the other embodiments described herein which are not repeated for the sake of brevity. The measurement apparatus 120 includes an angling apparatus 191 that allows for the angle of projection of the optical device 150 to be changed. The ability to change the angle of projection allows for different calculations to be made. That is different bend angles on the conduit may be used with different projection angles allowing a single measurement apparatus 120 to be utilized with more than one angle measurement. In some embodiments the angles of the first bend 146 and second bend 148 are thirty degrees. However, forty-five degree angles may be used which would change the calculations and location of the projection on the handle 130. The measurement apparatus 120 also includes straps as attachment devices 180. Also depicted in FIG. 14 is an optical projection or laser 152 (See also FIGS. 8-10).

Figure 15:
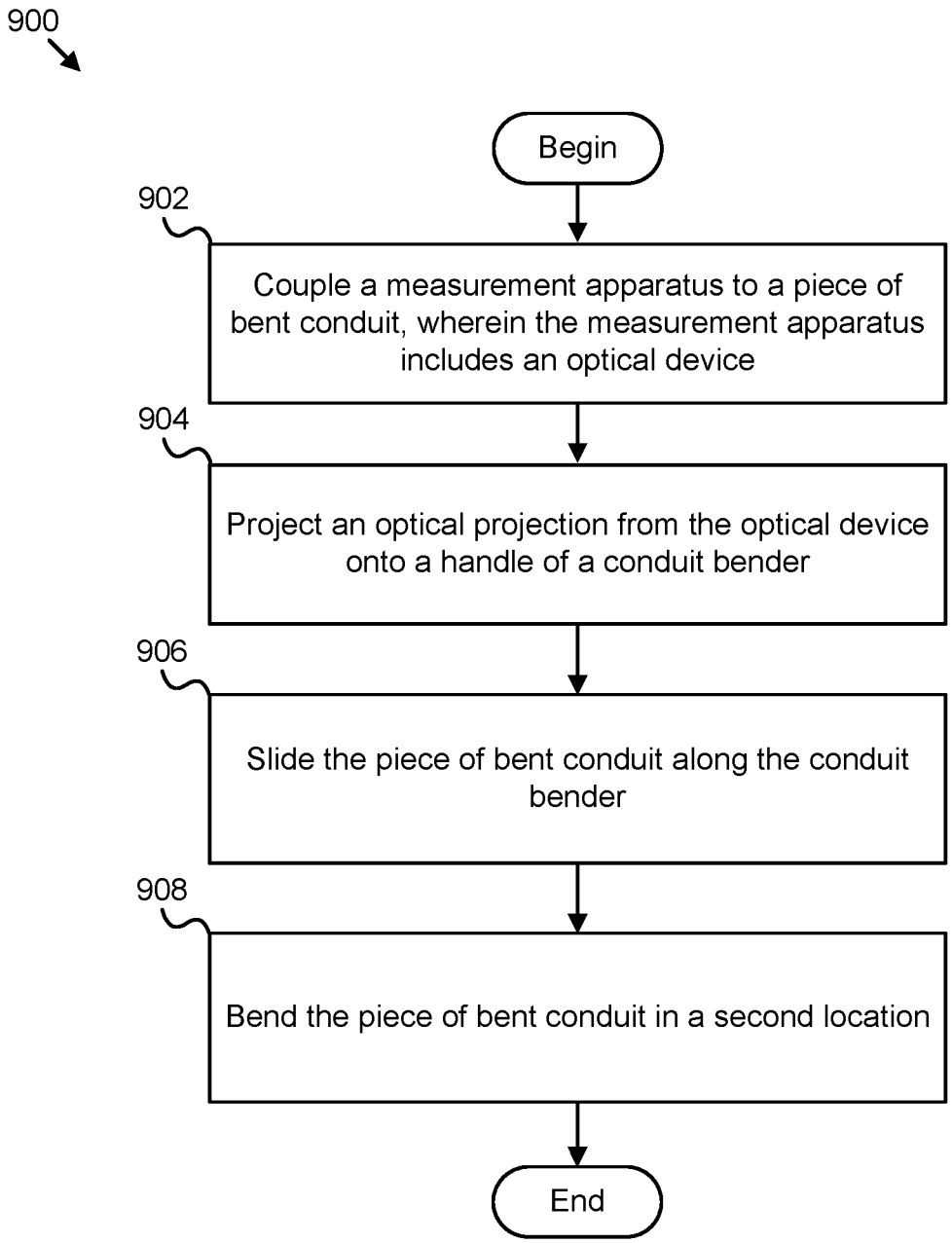
FIG. 15 is a schematic block diagram of a method, according to one or more embodiments of the present disclosure.

Referring to FIG. 15, a method 900 is disclosed. At block 902, the method 900 includes coupling a measurement apparatus to a piece of bent conduit, wherein measurement apparatus comprises an optical device. At block 904, the method 900 includes projecting an optical projection from the optical device onto a handle of a conduit bender. At block 906, the method 900 includes sliding the piece of bent conduit along the conduit bender. At block 908, the method 900 includes bending the piece of bent conduit in a second location. The method 900 then ends.

In some embodiments, the location of the optical projection on the length of the handle indicates an offset distance between a first linear section of the bent piece of conduit and an offset linear section of the bent piece of conduit, wherein the offset linear section is parallel to the first linear section.

Embodiments of apparatuses are described herein that may include on some of the features and components of the systems described. Additionally, other methods of using and making the systems described herein are contemplated.

Although the foregoing disclosure provides many specifics, these should not be construed as limiting the scope of any of the ensuing claims. Other embodiments may be devised which do not depart from the scopes of the claims. Features from different embodiments may be employed in combination. The scope of each claim is, therefore, indicated and limited only by its plain language and the full scope of available legal equivalents to its elements.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The present subject matter may be embodied in other specific forms without departing from its spirit or essential characteristics. The described embodiments are to be considered in all respects only as illustrative and not restrictive.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

What is claimed:

1. A bender tool measuring system, comprising:

a conduit bender comprising:

a bender head comprising a hook; and a handle coupled to and extending from the bender head, wherein the handle comprises a first set of markings;

a bent piece of conduit comprising a first linear section;

a measurement apparatus coupled to the bent piece of conduit, wherein the measurement apparatus comprises an optical device, wherein the optical device is configured to project an optical projection onto the handle of the conduit bender, wherein the optical device is configured to project the optical projection at an angle relative to a longitudinal plane running along a length of the first linear section, wherein the handle of the conduit bender is orthogonal to the longitudinal plane, wherein the angle is greater than zero degrees relative to the longitudinal plane running along the length of the first linear section, such that the optical projection projects at a single location on the handle, wherein the single location on the handle is a greater distance from the longitudinal plane than a starting location where the optical projection begins at the optical device, and wherein the single location indicates an offset distance that is made when making a second bend in the bent piece of conduit.

2. The system of claim 1, wherein the measurement apparatus comprises an attachment device and wherein the handle comprises a second set of markings, wherein the second set is spaced differently from the first set of markings.

3. The system of claim 1, wherein the angle is such that the optical device is configured to project the optical projection down the handle in a direction away from the bender head.

4. The system of claim 2, wherein the optical device comprises a laser.

5. The system of claim 1, wherein the measurement apparatus is coupled to the bent piece of conduit by a magnet.

6. The system of claim 5, wherein the measurement apparatus is coupled to the first linear section of the bent piece of conduit on an underside of the first linear section next to a first bent section of the bent piece of conduit.

7. The system of claim 1, wherein the measurement apparatus is coupled to the bent piece of conduit by a strap.

8. The system of claim 1, wherein the measurement apparatus comprises:

a housing with the optical device within, a power source, and a switch configured to provide power to the optical device within the housing;

an attachment device configured to couple the housing to the bent piece of conduit.

9. The system of claim 1, wherein the measurement apparatus is configured to project the optical projection at the angle from the first linear section of the bent piece of conduit, wherein the optical projection is a laser beam.

10. The system of claim 1, wherein the optical projection is configured to project onto the handle at the angle, wherein the angle is less than ninety degrees.

11. The system of claim 10, wherein the first set of markings vary in distance between each other along the handle.

12. The system of claim 10, wherein the single location of the optical projection on the length of the handle indicates the position of the bent piece of conduit in relation to the bender head, and wherein the optical device is configured to project the optical projection in a direction askew of parallel with the first linear section.

13. The system of claim 10, wherein the single location of the optical projection on the length of the handle indicates the offset distance between the first linear section of the bent piece of conduit and an offset linear section of the bent piece of conduit, wherein the offset linear section is parallel to the first linear section.

14. A measurement apparatus for a bender tool, comprising:

a housing comprising:

an optical device; and a power source configured to power the optical device;

an attachment device configured to couple the housing to a bent piece of conduit, the bent piece of conduit comprising a first linear section, wherein the optical device is configured to project an optical projection onto a handle of a bender tool, and wherein the optical device is configured to project the optical projection at an angle relative to a longitudinal plane running along a length of the first linear section, wherein the handle of the conduit bender is orthogonal to the longitudinal plane, wherein the angle is greater than zero degrees relative to the longitudinal plane running along the length of the first linear section, such that the optical projection projects at a single location on the handle, wherein the single location on the handle is a greater distance from the longitudinal plane than a starting location where the optical projection begins at the optical device.

15. The measurement apparatus of claim 14, wherein the single location of the optical projection on the length of the handle indicates the position of the bent piece of conduit in relation to a bender head, and wherein the angle is such that the optical device is configured to project the optical projection down the handle in a direction away from the bender head.

16. The measurement apparatus of claim 14, wherein the single location of the optical projection on the length of the handle indicates an offset distance between the first linear section of the bent piece of conduit and an offset linear section of the bent piece of conduit, wherein the offset linear section is parallel to the first linear section.

17. The measurement apparatus of claim 14, wherein the attachment device comprises a magnet and wherein the measurement apparatus is coupled to the bent piece of conduit by the magnet.

18. The measurement apparatus of claim 14, wherein the optical device comprises a laser.

19. A method comprising:

coupling a measurement apparatus to a bent piece of conduit, the bent piece of conduit comprising a first linear section and wherein the measurement apparatus comprises an optical device;

projecting an optical projection from the optical device onto a handle of a conduit bender, wherein the optical device is configured to project the optical projection at an angle relative to a longitudinal plane running along a length of the first linear section, wherein the handle of the conduit bender is orthogonal to the longitudinal plane, wherein the angle is greater than zero degrees relative to the longitudinal plane running along the length of the first linear section, such that the optical projection projects at a single location on the handle, wherein the single location on the handle is a greater distance from the longitudinal plane than a starting location where the optical projection begins at the optical device;

sliding the bent piece of conduit along the conduit bender; and bending the bent piece of conduit in a second location, wherein the single location indicates an offset distance between the second location and the first linear section.

20. The method of claim 19, wherein the single location of the optical projection on the length of the handle indicates an offset distance between the first linear section of the bent piece of conduit and an offset linear section of the bent piece of conduit, wherein the offset linear section is parallel to the first linear section, and wherein the conduit bender comprises a bender head and the handle, and wherein the angle is such that the optical device is configured to project the optical projection down the handle in a direction away from the bender head.

* * * * *